US008968490B2

(12) United States Patent
Theisen et al.

(10) Patent No.: US 8,968,490 B2
(45) **Date of Patent: *Mar. 3, 2015**

(54) FERROMAGNETIC AMORPHOUS ALLOY RIBBON WITH REDUCED SURFACE PROTRUSIONS, METHOD OF CASTING AND APPLICATION THEREOF

(75) Inventors: Eric A. Theisen, Myrtle Beach, SC (US); James Perrozi, Myrtle Beach, SC (US); Yuichi Ogawa, Myrtle Beach, SC (US); Yuji Matsumoto, Tottori (JP); Daichi Azuma, Myrtle Beach, SC (US); Ryusuke Hasegawa, Morristown, NJ (US)

(73) Assignees: Metglas, Inc., Conway, SC (US); Hitachi Metals, Ltd., Tokyo (JP)

( * ) Notice: Subject to any disclaimer, the term of this patent is extended or adjusted under 35 U.S.C. 154(b) by 330 days.

This patent is subject to a terminal disclaimer.

(21) Appl. No.: 12/923,224

(22) Filed: Sep. 9, 2010

(65) Prior Publication Data

US 2012/0062351 A1 Mar. 15, 2012

(51) Int. Cl.
*H01F 27/25* (2006.01)
*B22D 11/00* (2006.01)
(Continued)

(52) U.S. Cl.
CPC ..... *B22D 11/0611* (2013.01); *B22D 11/001* (2013.01); *H01F 1/15308* (2013.01); *H01F 27/25* (2013.01); *H01F 41/0226* (2013.01); *H01F 1/15333* (2013.01)
USPC ..... 148/304; 148/103; 336/213; 164/462; 29/605

(58) Field of Classification Search
USPC ..... 148/304
See application file for complete search history.

(56) References Cited

U.S. PATENT DOCUMENTS 4,264,882 A * 4/1981 Tsuya et al. ..... 333/141
4,768,458 A 9/1988 Arakawa et al.
(Continued)

FOREIGN PATENT DOCUMENTS

JP 61-24208 2/1986
JP 11-302823 11/1999

OTHER PUBLICATIONS

Machine Translation of JP 2009-052064, Mar. 12, 2009.*
(Continued)

*Primary Examiner* — Roy King
*Assistant Examiner* — Xiaowei Su

(57) ABSTRACT

A ferromagnetic amorphous alloy ribbon includes an alloy having a composition represented by $Fe_aSi_bB_cC_d$ where 80.5≤a≤83 at. %, 0.5≤b≤6 at. %, 12≤c≤16.5 at. %, 0.01≤d≤1 at. % with a+b+c+d=100 and incidental impurities, the ribbon being cast from a molten state of the alloy with a molten alloy surface tension of greater than or equal to 1.1 N/m on a chill body surface; the ribbon having a ribbon length, a ribbon thickness, and a ribbon surface facing the chill body surface; the ribbon having ribbon surface protrusions being formed on the ribbon surface facing the chill body surface; the ribbon surface protrusions being measured in terms of a protrusion height and a number of protrusions; the protrusion height exceeding 3 μm and less than four times the ribbon thickness, and the number of protrusions being less than 10 within 1.5 m of the cast ribbon length; and the alloy ribbon in its annealed straight strip form having a saturation magnetic induction exceeding 1.60 T and exhibiting a magnetic core loss of less than 0.14 W/kg when measured at 60 Hz and at 1.3 T induction level in its annealed straight strip form. The ribbon is suitable for transformer cores, rotational machines, electrical chokes, magnetic sensors, and pulse power devices.

42 Claims, 8 Drawing Sheets

Ribbon surface on chill body side

(51) Int. Cl.

| | |
|---|---|
| ***B22D 11/06*** | (2006.01) |
| ***H01F 1/153*** | (2006.01) |
| ***H01F 41/02*** | (2006.01) |

(56) References Cited

U.S. PATENT DOCUMENTS

| | | | | |
|---|---|---|---|---|
| 4,865,664 | A | 9/1989 | Sato et al. | |
| 5,741,373 | A * | 4/1998 | Suzuki et al. | 148/306 |
| 5,833,769 | A | 11/1998 | Kogiku et al. | |
| 6,273,967 | B1 | 8/2001 | Matsuki et al. | |
| 6,425,960 | B1 * | 7/2002 | Yoshizawa et al. | 148/300 |
| 7,988,798 | B2 | 8/2011 | Ozaki et al. | |
| 2003/0150528 | A1 | 8/2003 | Martis et al. | |
| 2006/0000524 | A1 | 1/2006 | Ogawa et al. | |
| 2006/0000525 | A1 * | 1/2006 | Naoe et al. | 148/304 |
| 2006/0191602 | A1 * | 8/2006 | Hasegawa et al. | 148/304 |
| 2009/0065100 | A1 * | 3/2009 | Yoshizawa et al. | 148/305 |
| 2009/0145524 | A1 * | 6/2009 | Ogawa et al. | 148/304 |
| 2010/0163136 | A1 * | 7/2010 | Ozaki et al. | 148/304 |

OTHER PUBLICATIONS

International Search Report and Written Opinion of the International Searching Authority mailed Jan. 17, 2012 issued in corresponding International Patent Application No. PCT/US11/49841.

International Preliminary Report on Patentability mailed Sep. 11, 2012 in corresponding International Patent Application No. PCT/US11/49841.

Office Action mailed Sep. 3, 2013 in U.S. Appl. No. 12/923,074.

Office Action mailed Sep. 3, 2013 in U.S. Appl. No. 12/923,076.

Lim et al., Magnetic Properties of Amorphous Alloy Strips Fabricated by Planar Flow Casting (PFC), Journal of Physics, 2009, 5 pages.

U.S. Appl. No. 12/923,074, filed Aug. 31, 2010, Ogawa et al., Metglas, Inc. and Hitachi Metals, Ltd.

U.S. Appl. No. 12/923,076, filed Aug. 31, 2010, Azuma et al., Metglas, Inc. and Hitachi Metals, Ltd.

Taiwanese Office Action for related Taiwanese Patent Application No. 100131134, issued on Jan. 23, 2014.

Taiwanese Office Action for related Taiwanese Patent Application No. 100131136, mailed on Jan. 23, 2014.

Japanese Office Action dated Aug. 1, 2014 in related Japanese Patent Application No. 2013-527186.

Japanese Office Action dated Aug. 1, 2014 in related Japanese Patent Application No. 2013-527188.

U.S. Office Action dated Aug. 6, 2014 in related U.S. Appl. No. 12/923,074.

U.S. Office Action dated Aug. 6, 2014 in related U.S. Appl. No. 12/923,076.

* cited by examiner

Ribbon surface on chill body side

RIBBON LENGTH DIRECTION

FERROMAGNETIC AMORPHOUS ALLOY RIBBON WITH REDUCED SURFACE PROTRUSIONS, METHOD OF CASTING AND APPLICATION THEREOF

BACKGROUND

1. Field

The present invention relates to a ferromagnetic amorphous alloy ribbon for use in transformer cores, rotational machines, electrical chokes, magnetic sensors and pulse power devices and a method of fabrication of the ribbon.

2. Description of the Related Art

Iron-based amorphous alloy ribbon exhibits excellent soft magnetic properties including low magnetic loss under AC excitation, finding its application in energy efficient magnetic devices such as transformers, motors, generators, energy management devices including pulse power generators and magnetic sensors. In these devices, ferromagnetic materials with high saturation inductions and high thermal stability are preferred. Furthermore, the ease of the materials' manufacturability and their raw material costs are important factors in large scale industrial use. Amorphous Fe—B—Si based alloys meet these requirements. However, the saturation inductions of these amorphous alloys are lower than those of crystalline silicon steels conventionally used in devices such as transformers, resulting in somewhat larger sizes of the amorphous alloy-based devices. Thus efforts have been made to develop amorphous ferromagnetic alloys with higher saturation inductions. One approach is to increase the iron content in the Fe-based amorphous alloys. However, this is not straightforward as the alloys' thermal stability degrades as the Fe content increases. To mitigate this problem, elements such as Sn, S, C and P have been added. For example, U.S. Pat. No. 5,456,770 (the '770 Patent) teaches amorphous Fe—Si—B—C—Sn alloys in which the addition of Sn increases the alloys' formability and their saturation inductions. In U.S. Pat. No. 6,416,879 (the '879 Patent), addition of P in an amorphous Fe—Si—B—C—P system is taught to increase saturation inductions with increased Fe content. However, addition of such elements as Sn, S and C in the Fe—Si—B-based amorphous alloys reduces the ductility of the cast ribbon rendering it difficult to fabricate a wide ribbon, and addition of P in the Fe—Si—B—C-based alloys as taught in the '879 Patent results in loss of long-term thermal stability which in turn leads to increase of magnetic core loss by several tens of percentage within several years. Thus, the amorphous alloys taught in the '770 and '879 Patents have not been practically fabricated by casting from their molten states.

In addition to a high saturation induction needed in magnetic devices such as transformers, inductors and the like, a high B—H squareness ratio and low coercivity, $H_c$, are desirable with B and H being magnetic induction and exciting magnetic field, respectively. The reason for this is: such magnetic materials have a high degree of magnetic softness, meaning ease of magnetization. This leads to low magnetic losses in the magnetic devices using these magnetic materials. Realizing these factors, the present inventors found that these required magnetic properties in addition to high ribbon-ductility were achieved by maintaining the C precipitation layer on ribbon surface at a certain thickness by selecting the ratio of Si:C at certain levels in an amorphous Fe—Si—B—C system as described in U.S. Pat. No. 7,425,239. Furthermore, in Japanese Kokai Patent No. 2009052064, a high saturation induction amorphous alloy ribbon is provided, which shows improved thermal stability of up to 150 years at 150° C. device operation by controlling the C precipitation layer height with addition of Cr and Mn into the alloy system. However, the fabricated ribbon exhibited a number of protrusions on the ribbon surface facing the moving chill body surface. A typical example of protrusion is shown in FIG. 1. The basic arrangement of casting nozzle, chill body surface on a rotating wheel and resulting cast ribbon is illustrated in U.S. Pat. No. 4,142,571.

Upon careful analysis of the nature of the protrusion and its formation, it was found that ribbon "packing factor" (PF) decreased when the height of a protrusion exceeded four times the ribbon thickness and/or when the number of protrusions exceeded 10 per 1.5 m along the ribbon's length direction. Here, packing factor, PF, is defined by the effective volume of ribbon when the ribbon is stacked or laminated. A higher PF is desired when a stacked or laminated product is used in a magnetic component when a smaller magnetic component is needed.

Thus, there is a need for a ferromagnetic amorphous alloy ribbon which exhibits a high saturation induction, a low magnetic loss, a high B—H squareness ratio, high mechanical ductility, high long-term thermal stability, and reduced number of ribbon surface protrusions with high level of ribbon fabricability, which is an objective of the present invention. More specifically, a thorough study of the cast ribbon surface quality during casting led to the following findings: when protrusion height exceeded four times the ribbon thickness or when the number of protrusions exceeded 10 over cast ribbon length of 1.5 m, casting had to be terminated in order to meet a packing factor PF>82% which was a minimum PF required in the industry. Generally protrusion height and number increased with casting time. For conventional amorphous alloy ribbons having saturation induction, $B_s$, less than 1.6 T, ribbon casting time was about 500 minutes before protrusion height exceeded four times the ribbon thickness or protrusion number increased to 10 per 1.5 m length of cast ribbon. For the amorphous alloy ribbons having $B_s$>1.6 T, casting time was often reduced to about 120 minutes, resulting in cast termination rate of 25%. Thus, it is clearly needed to clarify the cause of protrusion formation and to control it, which is another aspect of the present invention.

SUMMARY

In accordance with aspects of the invention, a ferromagnetic amorphous alloy ribbon is cast from an alloy having a composition represented by $Fe_aSi_bB_cC_d$ where 80.5≤a≤83 at. %, 0.5≤b≤6 at. %, 12≤c≤16.5 at. %, 0.01≤d≤1 at. % with a+b+c+d=100 and incidental impurities. The ribbon is being cast from a molten state of the alloy with a molten alloy surface tension of greater than or equal to 1.1 N/m on a chill body surface, and the ribbon has a ribbon length, a ribbon thickness, and a ribbon surface facing the chill body surface. The ribbon has ribbon surface protrusions being formed on the ribbon surface facing the chill body surface, and the ribbon surface protrusions are measured in terms of a protrusion height and a number of protrusions. The protrusion height exceeds 3 μm and less than four times the ribbon thickness, and the number of protrusions is less than 10 within 1.5 m of the ribbon length. The ribbon, in its annealed straight strip form, has a saturation magnetic induction exceeding 1.60 T and exhibits a magnetic core loss of less than 0.14 W/kg when measured at 60 Hz and at 1.3 T induction level.

According to one aspect of the invention, the ribbon has a composition in which the Si content b and B content c are related to the Fe content a and the C content d according to the relations of b≥166.5×(100−d)/100−2a and c≤a−66.5×(100−d)/100.

According to another aspect of the invention, in the ribbon, up to 20 at. % of Fe is optionally replaced by Co, and up to 10 at. % Fe is optionally replaced by Ni.

According to an additional aspect of the invention, the ribbon further includes a trace element of at least one of Cu, Mn and Cr in order to reduce ribbon surface protrusion on chill body side of ribbon. The concentrations for the trace elements are: Cu in a range between 0.005 wt. % and 0.20 wt. %, Mn in a range between 0.05 wt. % and 0.30 wt. %, and Cr in a range between 0.01 wt. % to 0.2 wt. %.

According to yet another aspect of the invention, the ribbon is being cast in a molten state of the alloy at temperatures between 1,250° C. and 1,400° C. The preferred temperature is is in the range between 1,280° C. and 1,360° C.

According to yet an additional aspect of the invention, the ribbon is being cast in an environmental atmosphere containing less than 5 vol. % oxygen at the molten alloy-ribbon interface.

According to one more aspect of the invention, the molten alloy surface tension is greater than or equal to 1.1 N/m.

According to another aspect of the invention, a wound magnetic core includes a ferromagnetic amorphous alloy ribbon and a magnetic core such that the ribbon is being wound into the magnetic core. According to an additional aspect, the wound magnetic core is a transformer core.

According to yet another aspect of the invention, the wound transformer core, after being annealed in a magnetic field applied along the direction of the ribbon's length, exhibits a magnetic core loss of less than 0.3 W/kg and an exciting power of less than 0.4 VA/kg at 60 Hz and 1.3 T induction.

According to yet an additional aspect of the invention, the ribbon of the wound magnetic core is cast from the alloy having the chemical composition represented by $Fe_aSi_bB_cC_d$ where $81 \le a < 82.5$ at. %, $2.5 < b < 4.5$ at. %, $12 \le c \le 16$ at. %, $0.01 \le d \le 1$ at. % with $a+b+c+d=100$ and satisfying the relations of $b \ge 166.5 \times (100-d)/100-2a$ and $c \le a-66.5 \times (100-d)/100$, and the alloy further includes a trace element that is at least one of Cu, Mn and Cr. The Cu content is at 0.005-0.20 wt. %, the Mn content is at 0.05-0.30 wt. %, and the Cr content is at 0.01-0.2 at. %.

According to one further aspect of the invention, the ribbon of the wound magnetic core has been annealed in a magnetic field applied along a direction of the ribbon's length, and exhibits a magnetic core loss of less than 0.25 W/kg and an exciting power of less than 0.35 VA/kg at 60 Hz and 1.3 T induction. The wound transformer core is annealed in a temperature range between 300° C. and 335° C.

According to another aspect of the invention, the core of the wound transformer core is operating up to an induction level of 1.5-1.55 T at room temperature. According to a different aspect of the invention, the core has a toroidal shape or semi-toroidal shape. According to a further aspect of the invention, the core has step-lap joints. According to one more aspect of the invention, the core has over-lap joints.

According to an additional aspect of the invention, a method of casting a ferromagnetic amorphous alloy ribbon includes: selecting an alloy having a composition represented by $Fe_aSi_bB_cC_d$ where $80.5 \le a \le 83$ at. %, $0.5 \le b \le 6$ at. %, $12 \le c \le 16.5$ at. %, $0.01 \le d \le 1$ at. % with $a+b+c+d=100$ and incidental impurities; casting from a molten state of the alloy with a molten alloy surface tension of greater than or equal to 1.1 N/m on a chill body surface; and obtaining the ribbon having a ribbon length, a ribbon thickness, and a ribbon surface facing the chill body surface. The ribbon has ribbon surface protrusions formed on the ribbon surface facing the chill body surface, and the ribbon surface protrusions are measured in terms of a protrusion height and a number of protrusions. The protrusion height exceeds 3 μm and less than four times the ribbon thickness, and the number of protrusions is less than 10 within 1.5 m of the ribbon length. The ribbon, in its annealed straight strip form, has a saturation magnetic induction exceeding 1.60 T and exhibits a magnetic core loss of less than 0.14 W/kg when measured at 60 Hz and at 1.3 T induction level.

BRIEF DESCRIPTION OF THE DRAWINGS

The invention will be more fully understood and further advantages will become apparent when reference is made to the following detailed description of the preferred embodiments and the accompanying drawings in which.

DETAILED DESCRIPTION

An amorphous alloy can be prepared, as taught in U.S. Pat. No. 4,142,571, by having a molten alloy ejected through a slotted nozzle onto a rotating chill body surface. The ribbon surface facing the chill body surface looks dull; but the opposite side, which is the surface facing the cast atmosphere, is shiny, reflecting the liquid nature of the molten alloy. In the following description of embodiments of the present invention, this side is also called "shiny side" of a cast ribbon. It was found that the formation of protrusion on the dull side of a cast ribbon was affected by the surface tension of a molten alloy. When protrusions are formed on an amorphous alloy ribbon surface, ribbon packing factor decreases in a magnetic component built by laminating or winding the ribbon. Thus, low level of protrusion height must be maintained to meet industry requirements. Protrusion height, on the other hand, increased with ribbon casting time, which limited casting time. For example, for conventional amorphous alloy ribbons with saturation induction less than 1.6 T, casting time was about 500 minutes before ribbon packing factor decreased to the level of 82% which was, for example, the minimum number in the transformer core industry. For amorphous magnetic alloys with a saturation induction, $B_s$, higher than 1.6 T developed thus far, casting time was about 120 minutes for the required 82% for the packing factor.

Further observation revealed the following: when casting was performed such that the protrusion height exceeded 3 μm and less than four times the ribbon thickness and the number of protrusions was less than 10 within 1.5 m of cast ribbon, ribbon casting time was considerably increased. After a number of experimental trials, the inventors found that maintaining the molten alloy surface tension at a high level was crucial to reduce the protrusion height and its occurrence incidence.

Figure 1:
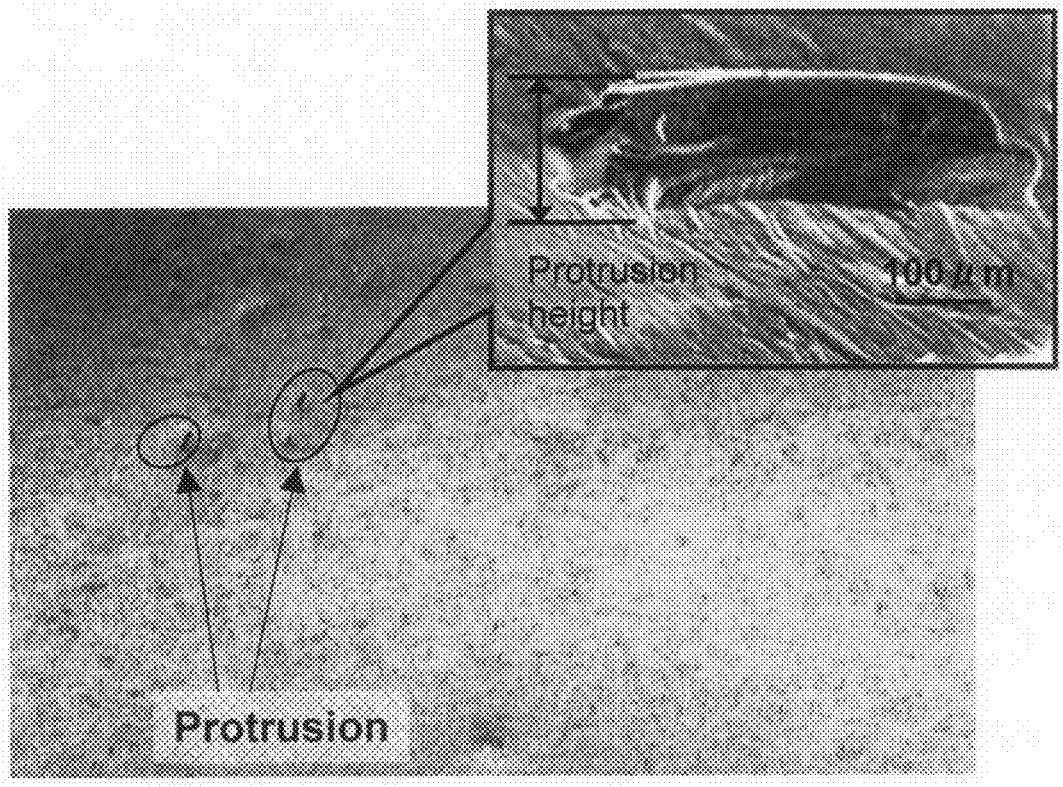
FIG. 1 is a picture showing a typical protrusion on a ribbon surface facing the chill body surface of a moving chill body.
Figure 2:
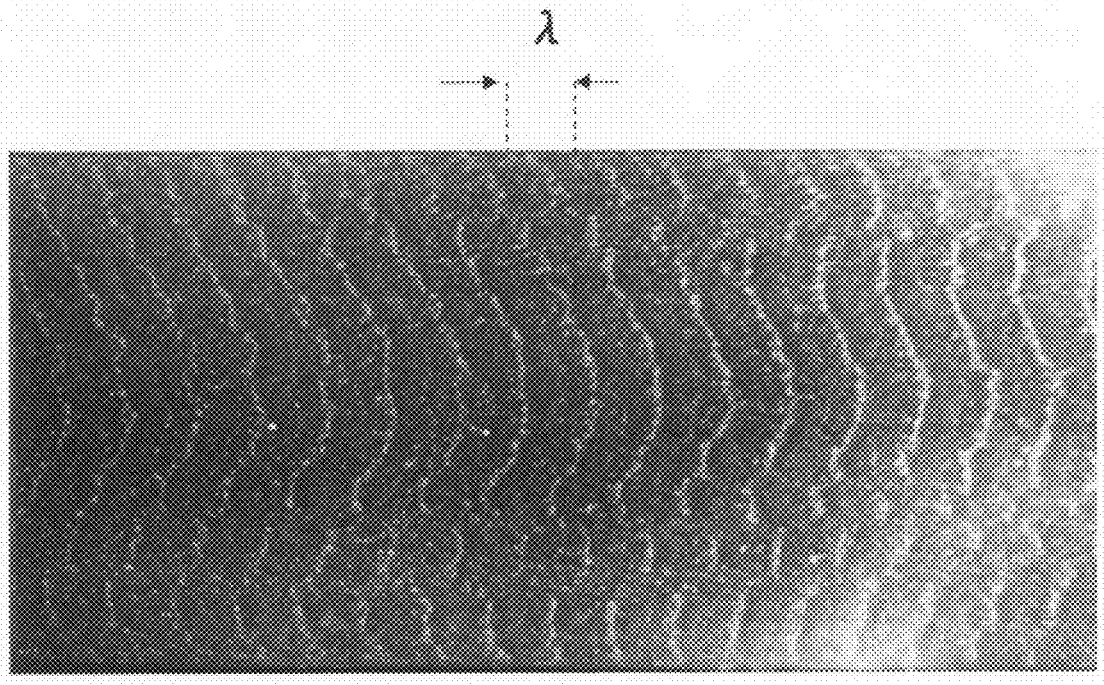
FIG. 2 is a picture showing a wavy pattern observed on a ribbon surface facing casting atmosphere side of cast ribbon. The quantity λ is the wave length of the pattern.

To quantify molten alloy surface tension, σ, the following formula was adopted from *Metallurgical and Materials Transactions*, vol. 37B, pp. 445-456 (published by Springer in 2006):

$$\sigma=U^2G^3\rho/3.6\lambda^2$$

where U, G, ρ and λ are chill body surface velocity, gap between nozzle and chill body surface, mass density of alloy and wave length of wavy pattern observed on the shiny side of ribbon surface as indicated in FIG. 2, respectively. The measured wavelength, λ, was in the range of 0.5 mm-2.5 mm.

The next step the present inventors took was to find the chemical composition range in which the saturation induction of a cast amorphous ribbon exceeded 1.60 T which was one of the aspects of the present invention. It was found that the alloy compositions meeting this requirement were expressed by $Fe_aSi_bB_cC_d$ where 80.5≤a≤83 at. %, 0.5≤b≤6 at. %, 12≤c≤16.5 at. %, 0.01≤d≤1 at. % with a+b+c+d=100 and incidental impurities commonly found in the commercial raw materials such as iron (Fe), ferrosilicon (Fe—Si) and ferroboron (Fe—B).

For Si and B contents, it was found that the following chemistry restriction was more favorable to achieve the objectives: b≥166.5×(100−d)/100−2a and c≤a−66.5×(100−d)/100. In addition, for incidental impurities and intentionally added trace elements, the following elements with the given content ranges were found favorable: Mn at 0.05-0.30 wt. %, Cr at 0.01-0.2 wt. %, and Cu at 0.005-0.20 wt. %.

In addition, less than 20 at. % Fe is optionally replaced by Co and less than 10 at. % Fe was optionally replaced by Ni.

Figure 3:
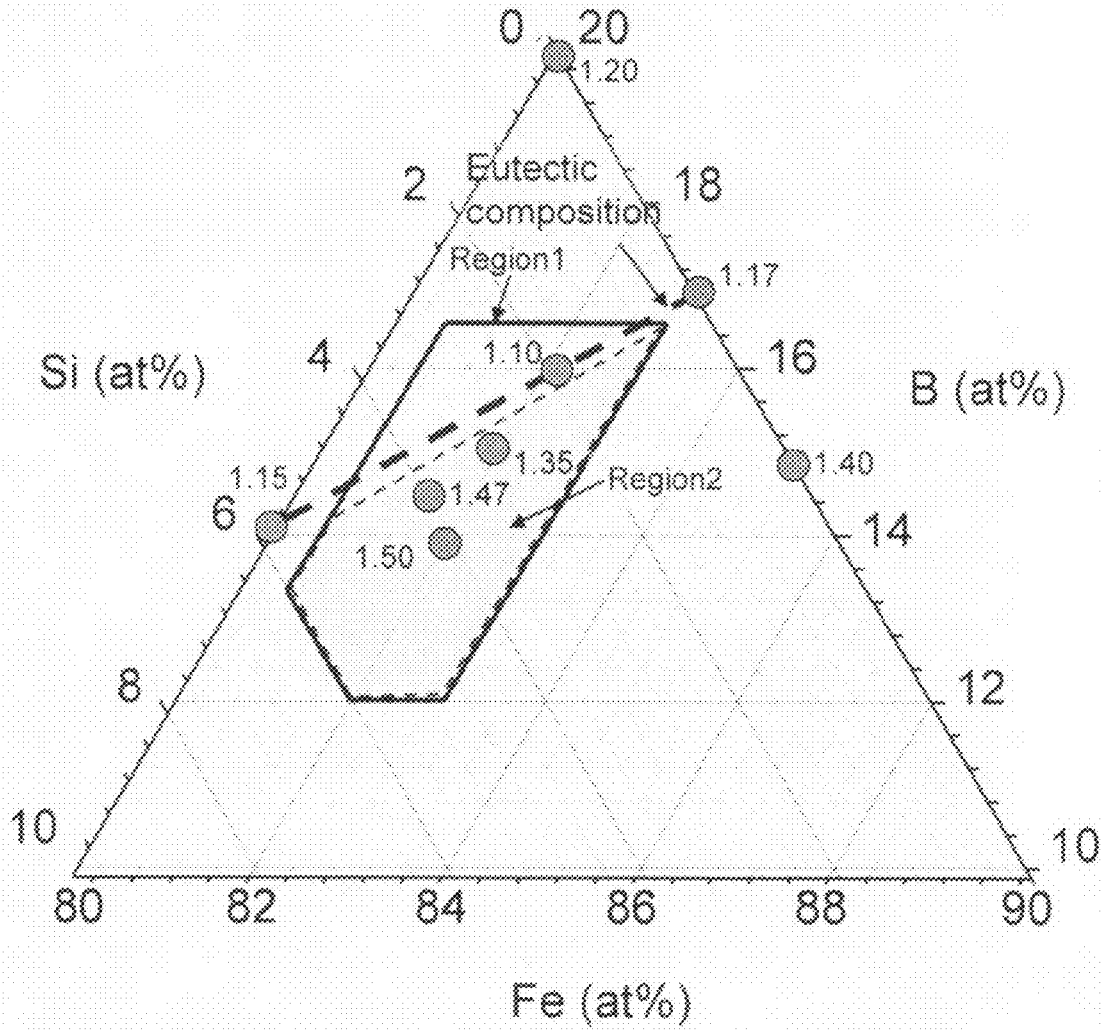
FIG. 3 is a diagram giving molten alloy surface tension on a Fe—Si—B phase diagram. The numbers shown indicate molten alloy surface tension in N/m.

The reasons for selecting the compositional ranges given in the previous three paragraphs above were the following: Fe content "a" of less than 80.5 at. % resulted in the saturation induction level of less than 1.60 T while "a" exceeding 83 at. % reduced alloy's thermal stability and ribbon formability. Replacing Fe by up to 20 at. % Co and/or up to 10 at. % Ni was favorable to achieve saturation induction exceeding 1.60 T. Si improved ribbon formability and enhanced its thermal stability and exceeded 0.5 at. % and was less than 6 at. % to achieve envisaged saturation induction levels and high B—H squareness ratios. B contributed favorably to alloy's ribbon formability and its saturation induction level and exceeded 12 at. % and was less than 16.5 at. % as its favorable effects diminished above this concentration. These findings are summarized in the phase diagram of FIG. 3, in which Region 1 where molten alloy surface tension is higher than or equal to 1.1 N/m and Region 2 where molten alloy surface tension exceeds 1.1 N/m are clearly indicated. The chemistry range represented by the formulas b≥166.5×(100−d)/100−2a and c≤a−66.5×(100−d)/100 corresponds to Region 2 in FIG. 3. The heavy dashed line in FIG. 2 corresponds to eutectic compositions and the light dashed line indicates chemical compositions in Region 2.

C was effective to achieve a high B—H squareness ratio and a high saturation induction above 0.01 at. % but molten alloy's surface tension is reduced above 1 at. % C and less than 0.5 at. % C is preferred. Among the added trace elements, Mn reduced molten alloy's surface tension and allowable concentration limits was Mn<0.3 wt. %. More preferably, Mn<0.2 wt. %. Coexistence of Mn and C in Fe-based amorphous alloys improved alloys' thermal stability and (Mn+C) >0.05 wt. % was effective. Cr also improved thermal stability and was effective for Cr>0.01 wt. % but alloy's saturation induction decreased for Cr>0.2 wt. %. Cu is not soluble in Fe and tends to precipitate on ribbon surface and was helpful in increasing molten alloy's surface tension; Cu>0.005 wt. % was effective and Cu>0.02 wt. % was more favorable but Cu>0.2 wt. % resulted in brittle ribbon. It was found that 0.01-5.0 wt. % of one or more than one element from a group of Mo, Zr, Hf and Nb were allowable.

The alloy, in accordance with an embodiment of the present invention, had a melting temperature preferably between 1,250° C. and 1,400° C. Below 1,250° C., nozzles tended to plug frequently and above 1,400° C. molten alloy's surface tension decreased. More preferred melting points were 1,280° C.-1,360° C.

Figure 4:
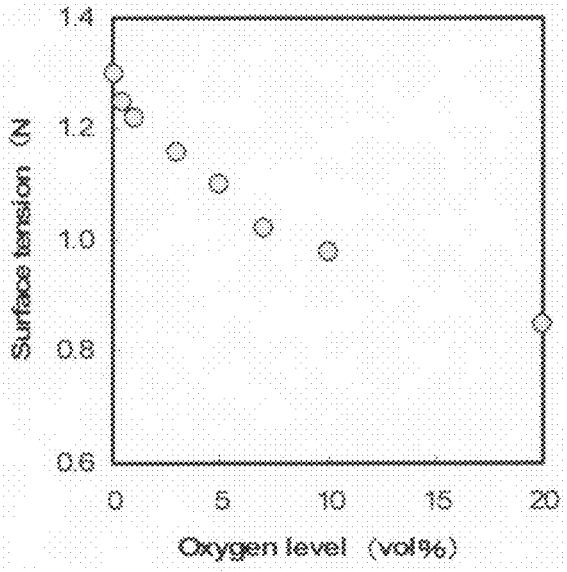
FIG. 4 is a graph showing molten alloy surface tension as a function of oxygen concentration in the vicinity of molten alloy-ribbon interface.

The inventors found that the surface protrusions could be further reduced by providing oxygen gas with a concentration of up to 5 vol. % at the interface between molten alloy and cast ribbon right below the casting nozzle. The upper limit for $O_2$ gas was determined based on the data of molten alloy surface tension versus $O_2$ concentration shown in FIG. 4 which indicated that molten alloy surface tension became less than 1.1 N/m for the oxygen gas concentration exceeding 5 vol. %. The relationship among $O_2$ gas level, molten alloy surface tension, σ, number of surface protrusions, n, and magnetic properties is given in Table 2.

Figure 5:
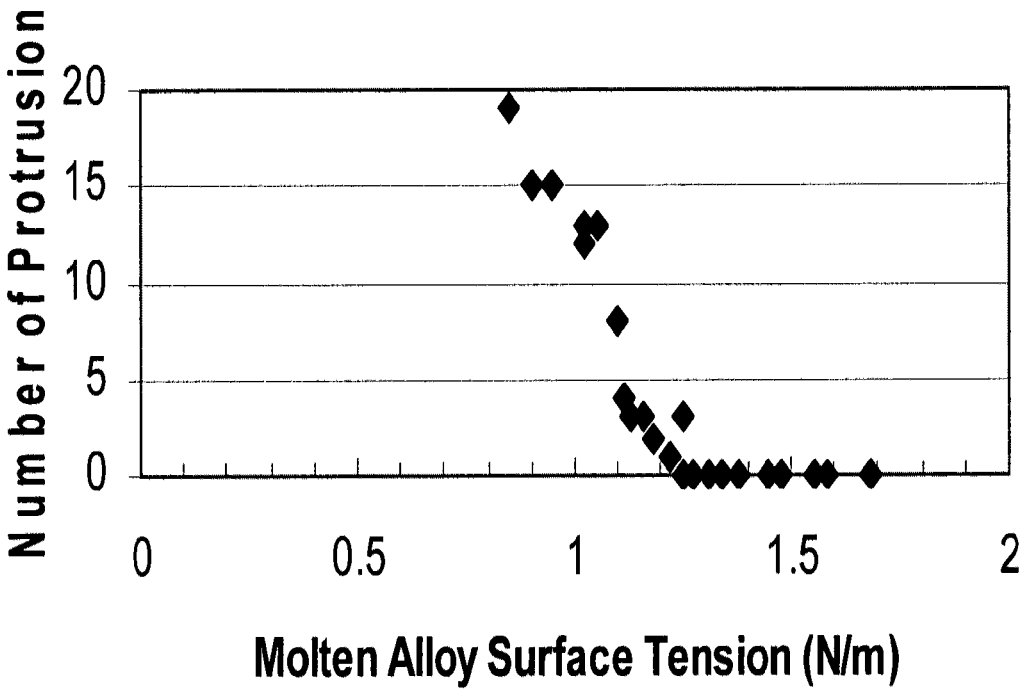
FIG. 5 is a graph showing number of protrusions per 1.5 m of cast ribbon as a function of molten alloy surface tension.

The next step was to correlate number of ribbon surface protrusions with molten alloy surface tension, which was shown in FIG. 5. This figure, representing without loss of generality from the data taken on cast ribbon with widths of 100 mm-170 mm and thickness of 23-25 μm, indicated that the number of surface protrusions increased as molten alloy surface tension, σ, decreased below 1.1 N/m. Also as Tables 1-6 indicated, the number of protrusions, n, per 1.5 m of cast ribbon became less than 10 for σ≥1.1 N/m. At σ=1.25 N/m, the number of protrusions becomes zero.

The inventors further found that the ribbon thickness from 10 μm to 50 μm was obtained according to embodiments of the inventions in the ribbon fabrication method. It was difficult to form a ribbon for thickness below 10 μm and above ribbon thickness of 50 μm ribbon's magnetic properties deteriorated.

The ribbon fabrication methods were applicable to wider amorphous alloy ribbons as indicated in Example 3.

To examine as many amorphous alloy ribbons as possible, a number of amorphous alloys for embodiments of the invention were tested and the results shown in Tables 4, 5 and 6. These tables were the basis for the physical ranges such as height of protrusions and their numbers per given length of cast amorphous alloy ribbons set forth for embodiments of the present invention.

To the surprise of the inventors, a ferromagnetic amorphous alloy ribbon showed a low magnetic core loss, contrary to the expectation that core loss generally increased when core material's saturation induction increased. For example, straight strips of ferromagnetic amorphous alloy ribbons according to embodiments of the present invention which were annealed at a temperature between 320° C. and 330° C. with a magnetic field of 1,500 A/m applied along the strips' length direction exhibited magnetic core loss of less than 0.14 W/kg when measured at 60 Hz and at 1.3 T induction.

A low magnetic core loss in a straight strip translates to correspondingly low magnetic core loss in a magnetic core prepared by winding a magnetic ribbon. However, due to the mechanical stress introduced during core winding, a wound core always exhibits magnetic core loss higher than that in its straight strip form. The ratio of wound core's core loss to straight strip's core loss is termed building factor (BF). The BF values are about 2 for optimally designed commercially available transformer cores based on amorphous alloy ribbons. A low BF value is obviously preferred. In accordance with embodiments of the present invention, transformer cores with over-lap joints were built using amorphous alloy ribbons of embodiments of the present invention. The dimension of the cores built and tested is given in FIG. 6.

Figure 6:
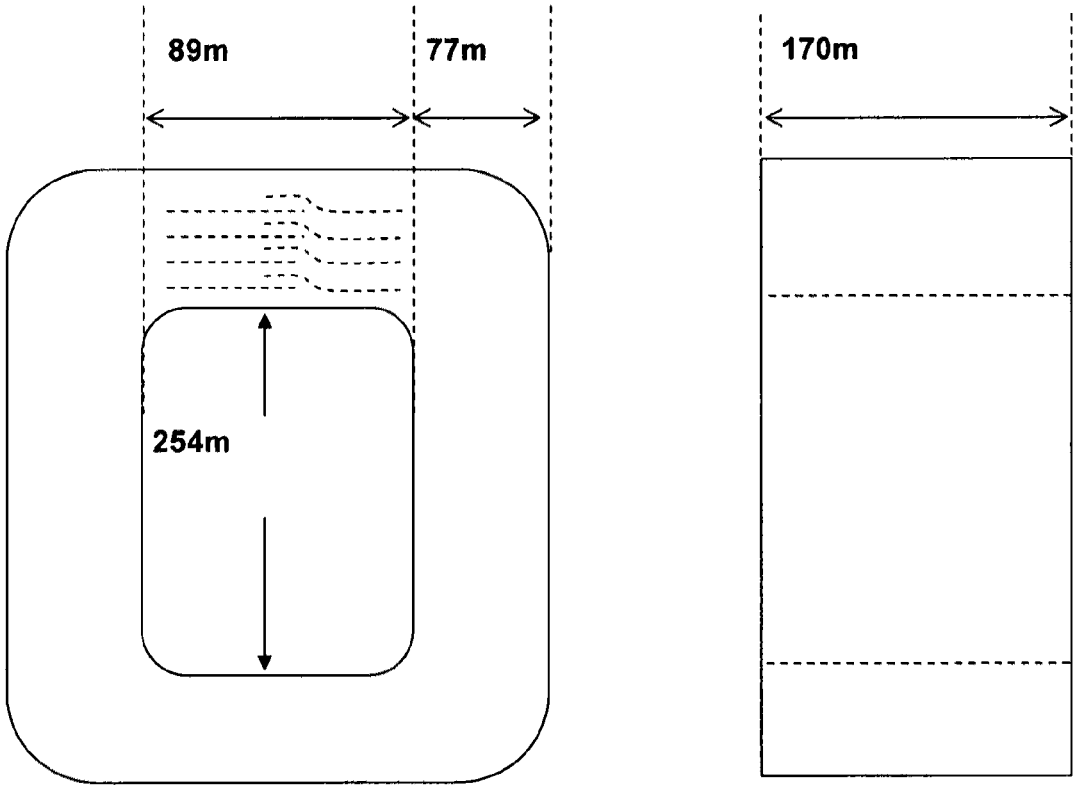
FIG. 6 is a diagram illustrating a transformer core with over-lap joints.
Figure 7:
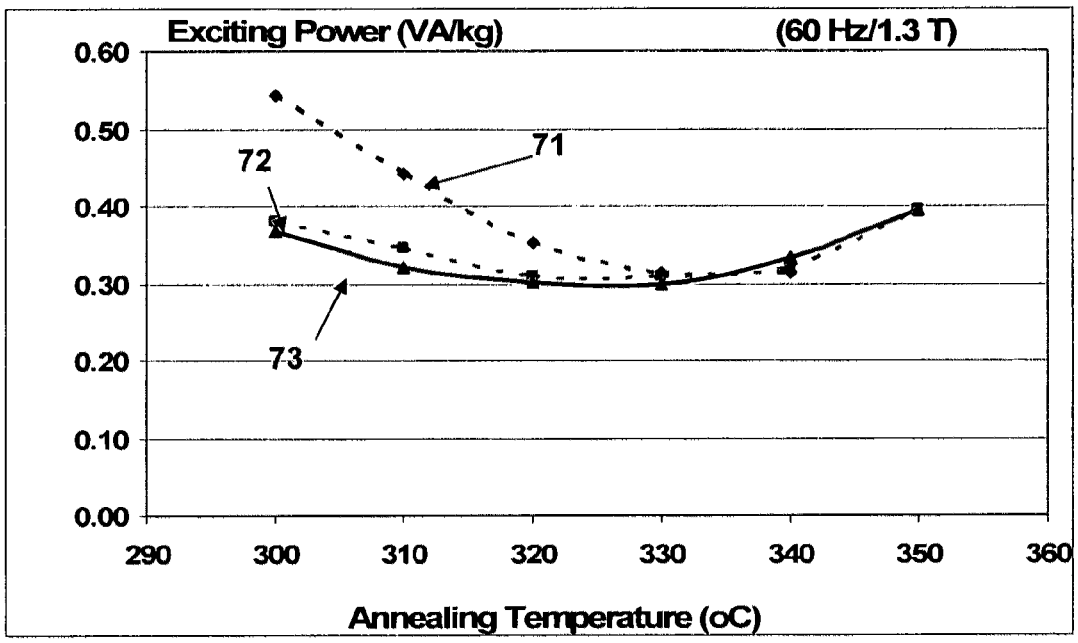
FIG. 7 is a graph showing exciting power at 60 Hz excitation and at 1.3 T induction as a function of annealing temperature for amorphous $Fe_{81.7}Si_2B_{16}C_{0.3}$, $Fe_{81.7}Si_3B_{15}C_{0.3}$ and $Fe_{81.7}Si_4B_{14}C_{0.3}$ alloy ribbons in magnetic cores annealed for one hour with a magnetic field of 2,000 A/m applied along ribbon's length direction.
Figure 8:
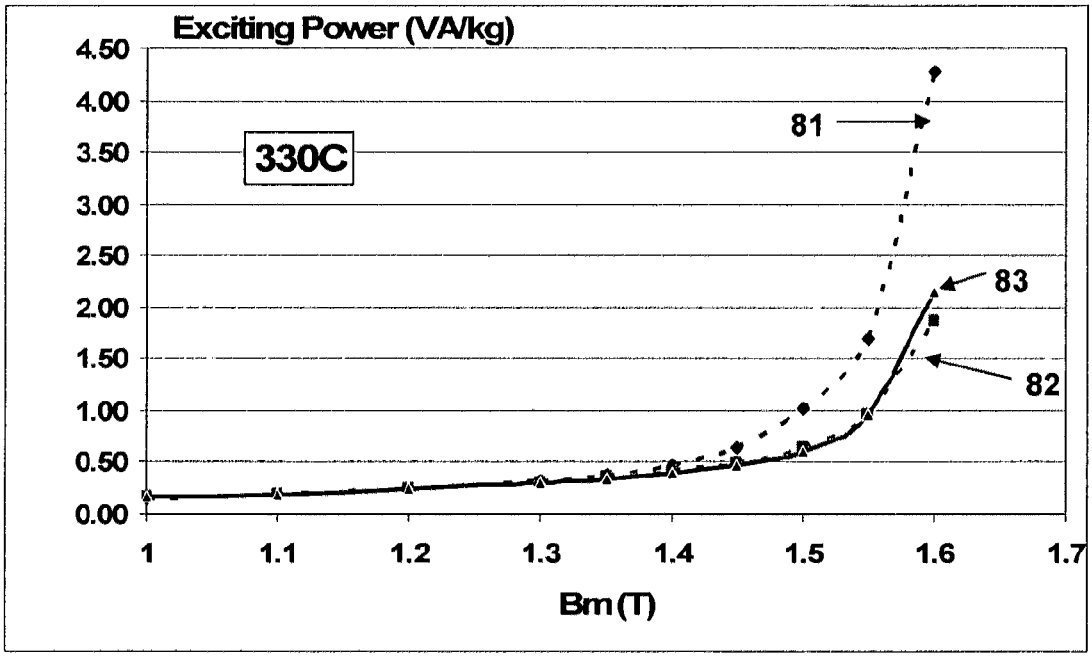
FIG. 8 is a graph showing exciting power at 60 Hz excitation as a function of magnetic induction $B_m$ for amorphous $Fe_{81.7}Si_2B_{16}C_{0.3}$, $Fe_{81.7}Si_3B_{15}C_{0.3}$ and $Fe_{81.7}Si_4B_{14}C_{0.3}$ alloy ribbons in magnetic cores annealed at 330° C. for one hour with a magnetic field of 2,000 A/m applied along ribbon's length direction.

The test results magnetic cores with the configuration of FIG. 6 are summarized in Tables 7 and 8. The first noticeable result is that core loss for example at 60 Hz and 1.3 T induction measured on a transformer core annealed at 300° C.-340° C. had a range of 0.211 W/kg-0.266 W/kg as shown in Table 7. This is to be compared with the core loss of less than 0.14 W/kg of a straight strip under the same 60 Hz excitation. Thus the BF values for these transformer cores ranged from 1.5 to 1.9, which were considerably lower than a conventional BF number of 2. Although core loss levels were about the same among the transformer cores tested, alloys with higher Si content showed the following two advantageous features. First, as indicated in Table 7, the annealing temperature range in which exciting power was low was much wider in the amorphous alloys containing 3-4 at. % Si than in an amorphous alloy containing 2 at. % Si. This was depicted in FIG. 7, in which curves 71, 72 and 73 corresponded to the amorphous alloy ribbons containing 2 at. % Si, 3 at. % Si and 4 at. % Si, respectively. Exciting power in a magnetic core such as a transformer core is an important factor as it is the actual power to keep a magnetic core in an excited state. Thus the lower the exciting power the better, resulting in more efficient transformer operation. Second, as indicated in Table 8, the transformer cores with amorphous alloy ribbons containing 3-4 at. % Si annealed in the temperature range between 300° C. and 355° C. in a magnetic field applied along ribbon's length direction were operated up to 1.5-1.55 T induction range above which exciting power increased rapidly at room temperature whereas the amorphous alloy with 2 at. % Si was operable up to about 1.45 T above which exciting power increased rapidly in 2 at. % Si-based cores. This feature was clearly demonstrated in FIG. 8, in which curves 81, 82 and 83 corresponded to the amorphous alloy ribbons containing 2 at. % Si, 3 at. % Si and 4 at. % Si, respectively. This difference is significant in reducing the transformer size. It is estimated that the transformer size can be reduced by 5-10% for incremental increase of its operating induction by 0.1 T. Furthermore transformer quality improves when its exciting power is low. In light of these technical advantages, transformer cores having the compositions in accordance with the present invention were tested and the results indicated that optimal transformer performance was achieved in the amorphous alloys with the chemical compositions represented by $Fe_aSi_bB_cC_d$ where $81 \le a < 82.5$ at. %, $2.5 < b < 4.5$ at. %, $12 \le c \le 16$ at. %, $0.01 \le d \le 1$ at. % with $a+b+c+d=100$ and satisfying the relations of $b \ge 166.5 \times (100-d)/100-2a$ and $c \le a-66.5 \times (100-d)/100$.

Example 1

Ingots with chemical compositions, in accordance with embodiments of the present invention, were prepared and were cast from molten metals at 1,350° C. on a rotating chill body. The cast ribbons had a width of 170 mm and its thickness was 23 μm. A chemical analysis showed that the ribbons contained 0.10 wt. % Mn, 0.03 wt. % Cu and 0.05 wt. % Cr. A mixture of $CO_2$ gas and oxygen was blown into near the interface between molten alloy and the cast ribbon. The oxygen concentration near the interface between molten alloy and the cast ribbon was 0.5 vol %. The molten alloy surface tension, σ, was determined by measuring the wave length of the wavy pattern on the shiny side of the cast ribbon using the formula $\sigma = U^2G^3\rho/3.6\lambda^2$. Ribbon surface protrusion number within 1.5 m along ribbon's length direction was measured on the ribbon cast for about 100 minutes and the maximum number, n, of surface protrusions of three samples with their heights exceeding 3 μm is given in Table 1. All the ribbon samples had protrusion heights less than 4 times the ribbon thickness. Single strips cut from the ribbons were annealed at 300° C.-400° C. with a magnetic field of 1500 A/m applied along strips' length direction and the magnetic properties of the heat-treated strips were measured according to ASTM Standards A-932. The results obtained are listed in Table 1. The samples Nos. 1 and 2 met the requirements of the invention objectives for the molten alloy surface tension, the number of surface protrusions per 1.5 m of the cast ribbon, the saturation induction, $B_s$, and the magnetic core loss $W_{1.3/60}$ at 60 Hz excitation at 1.3 T induction. Reference sample No. 1 had 12 protrusions, and therefore exceeded the minimum number of 10 required in embodiments of the present invention.

TABLE 1

| | Composition (at. %) | σ (N/m) | n | $B_s$ (T) | $W_{1.3/60}$ (W/kg) |
|---|---|---|---|---|---|
| Sample No. | | | | | |
| 1 | $Fe_{81.7}Si_3B_{15}C_{0.3}$ | 1.25 | 3 | 1.63 | 0.094 |
| 2 | $Fe_{81.7}Si_4B_{14}C_{0.3}$ | 1.38 | 0 | 1.63 | 0.093 |
| Ref. Sample No. | | | | | |
| 1 | $Fe_{81.4}Si_2B_{16}C_{0.6}$ | 1.02 | 12 | 1.64 | 0.091 |

Example 2

An amorphous alloy ribbon having a composition of $Fe_{81.7}Si_3B_{15}C_{0.3}$ was cast under the same casting condition as in Example 1 except that $O_2$ gas concentration was changed from 0.1 vol. % to 20 vol. % (equivalent to air). The magnetic properties, $B_s$ and $W_{1.3/60}$ and molten alloy surface tension σ and average number of surface defects, n obtained are listed in Table 2. The data demonstrate that oxygen level exceeding 5 vol. % reduces molten alloy surface tension, which in turn increase the surface protrusion number.

TABLE 2

| | Oxygen level Vol. (%) | σ (N/m) | n | $B_s$ (T) | $W_{1.3/60}$ (W/kg) |
|---|---|---|---|---|---|
| Sample No. | | | | | |
| 3 | 5 | 1.10 | 8 | 1.63 | 0.096 |
| 4 | 3 | 1.16 | 4 | 1.63 | 0.094 |
| 1 | 0.5 | 1.25 | 3 | 1.63 | 0.093 |
| Ref. Sample No. | | | | | |
| 2 | 7 | 1.02 | 13 | 1.63 | 0.101 |
| 3 | 20(Air) | 0.85 | 19 | 1.63 | 0.141 |

Example 3

An amorphous alloy ribbon having a composition of $Fe_{81.7}Si_3B_{15}C_{0.3}$ was cast under the same condition as in Example 1 except that ribbon width was changed from 50 mm to 254 mm and the ribbon thickness was changed from 15 μm to 40 μm. The magnetic properties, $B_s$, $W_{1.3/60}$ and molten alloy surface tension σ and number of surface protrusions, n, obtained are listed in Table 3.

TABLE 3

| Sample No. | Thickness (μm) | Width (mm) | σ (N/m) | n | $B_s$ (T) | $W_{1.3/60}$ (W/kg) |
|---|---|---|---|---|---|---|
| 7 | 25 | 50 | 1.16 | 2 | 1.63 | 0.097 |
| 8 | 25 | 140 | 1.16 | 3 | 1.63 | 0.098 |
| 9 | 25 | 170 | 1.16 | 3 | 1.63 | 0.100 |
| 10 | 25 | 210 | 1.16 | 4 | 1.63 | 0.101 |
| 11 | 25 | 254 | 1.16 | 4 | 1.63 | 0.105 |
| 12 | 15 | 170 | 1.16 | 3 | 1.63 | 0.105 |
| 13 | 22 | 170 | 1.16 | 4 | 1.63 | 0.101 |
| 14 | 30 | 170 | 1.16 | 5 | 1.63 | 0.106 |
| 15 | 40 | 170 | 1.16 | 6 | 1.63 | 0.114 |

Example 4

Ingots with the chemical compositions listed in Tables 5 and 6 were used to cast amorphous alloy ribbons as in Example 1. The casting was performed in an atmosphere containing 0.5 vol. % $O_2$ gas. The resultant ribbon had a thickness of 23 μm and a width of 100 mm. The number of ribbon surface protrusions and the ribbon's magnetic properties were determined as in Example 1 and the results are shown in Table 4. All of these examples met the required properties set forth for embodiments of the present invention.

TABLE 4

| | Composition (at %) | | | | | | | | | |
|---|---|---|---|---|---|---|---|---|---|---|
| Sample No. | Fe | Co | Ni | Si | B | C | σ (N/m) | n | Bs (T) | $W_{1.3/60}$ (W/kg) |
| 16 | 81.7 | 0 | 0 | 3 | 15 | 0.3 | 1.16 | 2 | 1.63 | 0.094 |
| 17 | 81.7 | 0 | 0 | 4 | 14 | 0.3 | 1.31 | 0 | 1.63 | 0.093 |
| 18 | 81.0 | 0 | 0 | 6 | 12 | 1 | 1.48 | 0 | 1.61 | 0.101 |
| 19 | 80.5 | 0 | 0 | 5 | 14.2 | 0.3 | 1.13 | 3 | 1.62 | 0.103 |
| 20 | 81.7 | 0 | 0 | 4.5 | 13.5 | 0.3 | 1.38 | 0 | 1.62 | 0.094 |
| 21 | 83.0 | 0 | 0 | 0.5 | 16.5 | 0.01 | 1.22 | 1 | 1.62 | 0.135 |
| 22 | 81.7 | 0 | 0 | 5 | 13 | 0.3 | 1.43 | 0 | 1.62 | 0.095 |
| 23 | 81.7 | 0 | 0 | 2.3 | 16 | 0.01 | 1.11 | 4 | 1.64 | 0.095 |
| 24 | 80.5 | 0 | 0 | 6 | 13.2 | 0.3 | 1.55 | 0 | 1.60 | 0.099 |
| 25 | 80.5 | 0 | 0 | 2.7 | 16.5 | 0.3 | 1.18 | 2 | 1.62 | 0.105 |
| 26 | 83.0 | 0 | 0 | 4.7 | 12 | 0.3 | 1.58 | 0 | 1.62 | 0.109 |
| 27 | 76.7 | 5 | 0 | 4 | 14 | 0.3 | 1.34 | 0 | 1.70 | 0.104 |
| 28 | 61.7 | 20 | 0 | 4 | 14 | 0.3 | 1.36 | 0 | 1.78 | 0.101 |
| 29 | 79.7 | 0 | 2 | 4 | 14 | 0.3 | 1.27 | 0 | 1.65 | 0.100 |
| 30 | 71.7 | 0 | 10 | 4 | 14 | 0.3 | 1.25 | 0 | 1.60 | 0.103 |

Amorphous alloy ribbons listed in Table 5, on the other hand, were made and examined as those in Table 4 but did not meet the requirements set forth for embodiments of the present invention.

TABLE 5

| Ref. sample | Composition (at %) | | | | σ | | $B_s$ | $W_{1.3/60}$ |
|---|---|---|---|---|---|---|---|---|
| No. | Fe | Si | B | C | (N/m) | n | (T) | (W/kg) |
| 6 | 81.4 | 2 | 16 | 0.6 | 0.95 | 15 | 1.64 | 0.091 |
| 7 | 79.7 | 8 | 12 | 0.3 | 1.45 | 0 | 1.57 | 0.095 |
| 8 | 81 | 3 | 14.8 | 1.2 | 1.05 | 13 | 1.63 | 0.103 |
| 9 | 80.5 | 4 | 14.9 | 0.6 | 0.90 | 15 | 1.62 | 0.096 |
| 10 | 83.7 | 2 | 14 | 0.3 | 1.58 | 0 | 1.58 | 0.124 |
| 11 | 81.7 | 8 | 10 | 0.3 | 1.68 | 0 | 1.59 | 0.120 |

Example 5

Cu containing $Fe_{81.7}Si_3B_{15}C_{0.3}$ amorphous alloys were cast as in Example 4 and the test results are listed in Table 6. Sample Nos. 16, 31 and 32 met the required properties set forth in embodiments of the present invention. Among reference samples, sample No. 12 showed more ribbon surface protrusion, n, whereas sample No. 13 met all the requirements but was brittle.

TABLE 6

| | Cu wt % | σ (N/m) | n | $B_s$ (T) | $W_{1.3/60}$ (W/kg) |
|---|---|---|---|---|---|
| Sample No. | | | | | |
| 16 | 0.03 | 1.16 | 2 | 1.63 | 0.094 |
| 31 | 0.20 | 1.25 | 1 | 1.63 | 0.093 |
| 32 | 0.005 | 1.10 | 10 | 1.63 | 0.106 |
| Ref. sample No. | | | | | |
| 12 | 0.001 | 1.05 | 13 | 1.62 | 0.091 |
| 13 | 0.25 | 1.28 | 0 | 1.61 | 0.108 |

Example 6

Amorphous alloy ribbons with compositions of $Fe_{81.7}Si_2B_{16}C_{0.3}$, $Fe_{81.7}Si_3B_{15}C_{0.3}$ and $Fe_{81.7}Si_4B_{14}C_{0.3}$ and with a thickness of 23 μm and a width of 170 mm were wound into magnetic cores with the dimensions shown in FIG. 6. The cores of FIG. 6 for use in transformers are known as over-lap type in the industry. The cores were annealed at 330° C. with a magnetic field of 2000 A/m applied along ribbon's length direction. The magnetic properties such as core loss and exciting power were measured according to ASTM Standards No. A-912. The test results are given in Tables 7 and 8 and FIGS. 7 and 8.

TABLE 7

| | Annealing temperature (° C.) | | | | | |
|---|---|---|---|---|---|---|
| | 300 | 310 | 320 | 330 | 340 | 350 |
| | Core Loss $CL_{1.3/60}$ (Wkg) | | | | | |
| $Fe_{81.7}Si_2B_{16}C_{0.3}$ | 0.229 | 0.232 | 0.220 | 0.216 | 0.243 | 0.306 |
| $Fe_{81.7}Si_3B_{15}C_{0.3}$ | 0.240 | 0.226 | 0.222 | 0.229 | 0.256 | 0.308 |
| $Fe_{81.7}Si_4B_{14}C_{0.3}$ | 0.216 | 0.211 | 0.217 | 0.225 | 0.266 | 0.311 |

TABLE 7-continued

| | Annealing temperature (° C.) | | | | | |
|---|---|---|---|---|---|---|
| | 300 | 310 | 320 | 330 | 340 | 350 |
| | Exciting Power $VA_{1.3/60}$ (VA/kg) | | | | | |
| $Fe_{81.7}Si_2B_{16}C_{0.3}$ | 0.544 | 0.443 | 0.354 | 0.314 | 0.314 | 0.395 |
| $Fe_{81.7}Si_3B_{15}C_{0.3}$ | 0.380 | 0.345 | 0.309 | 0.308 | 0.322 | 0.396 |
| $Fe_{81.7}Si_4B_{14}C_{0.3}$ | 0.368 | 0.322 | 0.301 | 0.299 | 0.334 | 0.396 |

TABLE 8

| | Induction $B_m$ (T) | | | | | | | | | |
|---|---|---|---|---|---|---|---|---|---|---|
| | 1.00 | 1.10 | 1.20 | 1.30 | 1.35 | 1.40 | 1.45 | 1.50 | 1.55 | 1.60 |
| | Core Loss $CL_{1.3/60}$ (Wkg) | | | | | | | | | |
| $Fe_{81.7}Si_2B_{16}C_{0.3}$ | 0.13 | 0.15 | 0.18 | 0.22 | 0.23 | 0.26 | 0.28 | 0.30 | 0.33 | 0.38 |
| $Fe_{81.7}Si_3B_{15}C_{0.3}$ | 0.14 | 0.17 | 0.20 | 0.23 | 0.25 | 0.26 | 0.28 | 0.31 | 0.33 | 0.37 |
| $Fe_{81.7}Si_4B_{14}C_{0.3}$ | 0.14 | 0.16 | 0.19 | 0.22 | 0.24 | 0.26 | 0.28 | 0.30 | 0.33 | 0.37 |
| | Exciting Power $VA_{1.3/60}$ (VA/kg) | | | | | | | | | |
| $Fe_{81.7}Si_2B_{16}C_{0.3}$ | 0.15 | 0.19 | 0.24 | 0.31 | 0.37 | 0.47 | 0.65 | 1.02 | 1.69 | 4.28 |
| $Fe_{81.7}Si_3B_{15}C_{0.3}$ | 0.16 | 0.20 | 0.25 | 0.31 | 0.35 | 0.41 | 0.49 | 0.64 | 0.95 | 1.87 |
| $Fe_{81.7}Si_4B_{14}C_{0.3}$ | 0.16 | 0.20 | 0.24 | 0.30 | 0.34 | 0.39 | 0.47 | 0.61 | 0.96 | 2.15 |

The transformer cores using the amorphous magnetic alloys given in Example 6 annealed between 300° C. and 350° C. exhibited core loss of less than 0.3 W/kg at 60 Hz and 1.3 T excitation and those annealed between 310° C. and 350° C. showed exciting power of less than 0.4 VA/kg. Optimal transformer core performance was obtained in the cores annealed at 320° C.-330° C. containing 3 at. %-4 at. % Si. For these cores, core loss of less than 0.25 W/kg and exciting power of less than 0.35 VA/kg at 60 Hz and 1.3 T induction were achieved, providing a preferred range for Si of 3-4 at. %. It is also noted that the cores containing 3-4 at % Si showed exciting power of much less than 1.0 VA/kg at 60 Hz and 1.5 T induction, which is a preferred exciting power range for efficient transformer operation.

Although embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A ferromagnetic amorphous alloy ribbon comprising:

an alloy having a composition represented by $Fe_aSi_bB_cC_d$ where 80.5≤a≤83 at. %, 0.5≤b≤6 at. %, 12≤c≤16.5 at. %, 0.01≤d≤1 at. % with a+b+c+d=100 and incidental impurities, having been cast from a molten state of the alloy with a molten alloy surface tension of greater than or equal to 1.1 N/m on a chill body surface, the ribbon having a ribbon length, a ribbon thickness, and a ribbon surface facing the chill body surface, the ribbon having ribbon surface protrusions on the ribbon surface facing the chill body surface with the surface protrusions growing in size and frequency with increasing casting time; the ribbon surface protrusions being measured in terms of a protrusion height and a number of protrusions, a number of points on the ribbon surface with protrusion heights exceeding 3 μm and less than four times the ribbon thickness, and the number of protrusions being greater than zero and less than 10 per area of 1.5 m of the ribbon length and 100 mm of the ribbon width, and the ribbon having a saturation magnetic induction exceeding 1.60 T and exhibiting a magnetic core loss of less than 0.14 W/kg when measured at 60 Hz and at a 1.3 T induction level in an annealed straight strip form, and a magnetic core loss of less than 0.3 W/kg and an exciting power of less than 0.4 VA/kg when measured at 60 Hz and at a 1.3 T induction level in an annealed wound transformer core form.

2. The ferromagnetic amorphous alloy ribbon of claim 1, wherein the Si content b and B content c are related to the Fe content a and the C content d according to the relations of b≥166.5×(100−d)/100−2a and c≤a−66.5×(100−d)/100.

3. The ferromagnetic amorphous alloy ribbon of claim 1, wherein up to 20 at. % of Fe is optionally replaced by Co, and up to 10 at. % Fe is optionally replaced by Ni.

4. The ferromagnetic amorphous alloy ribbon of claim 1, further comprising a trace element including both incidental and intentionally added impurities selected from at least a member from the group consisting of Cu, Mn and Cr.

5. The ferromagnetic amorphous alloy ribbon of claim 4, wherein the Cu content is in a range between 0.005 wt. % and 0.20 wt. %.

6. The ferromagnetic amorphous alloy ribbon of claim 4, wherein the Mn content is in a range between 0.05 wt. % and 0.30 wt. %.

7. The ferromagnetic amorphous alloy ribbon of claim 4, wherein the Cr content is in a range between 0.01 wt. % and 0.2 wt. %.

8. The ferromagnetic amorphous alloy ribbon of claim 1, wherein the ribbon has been cast in a molten state of the alloy at temperatures between 1,250° C. and 1,400° C.

9. The ferromagnetic amorphous alloy ribbon of claim 1, wherein the ribbon has been cast in an environmental atmosphere containing less than 5 vol. % oxygen gas at the molten alloy-ribbon interface.

10. The ferromagnetic amorphous alloy ribbon of claim 1, wherein the molten alloy surface tension of the molten state of the alloy from which the alloy has been cast is greater than or equal to 1.25 N/m.

11. A wound magnetic core, comprising a ribbon of claim 1, wherein the ribbon has been wound into the magnetic core.

12. A wound transformer core, comprising the wound magnetic core of claim 11.

13. The wound transformer core of claim 12, having been annealed in a magnetic field applied along ribbon's length direction.

14. The wound transformer core of claim 13, having been annealed in a temperature range between 300° C. and 335° C. in a magnetic field applied along ribbon's length direction.

15. The wound magnetic core of claim 11, wherein the ribbon is based on the alloy having the chemical composition represented by $Fe_aSi_bB_cC_d$ where 81≤a<82.5 at. %, 2.5<b<4.5 at. %, 12≤c≤16 at. %, 0.01≤d≤1 at. % with a+b+c+d=100 and satisfying the relations of b≥166.5×(100−d)/100−2a and c≤a−66.5×(100−d)/100, and the alloy further comprises a trace element selected from at least a member from the group consisting of Cu, Mn and Cr, wherein the Cu content is at 0.005-0.20 wt. %, the Mn content is at 0.05-0.30 wt. %, and the Cr content is at 0.01-0.2 at. %.

16. The wound magnetic core of claim 15, wherein the ribbon has been annealed in a magnetic field applied along a direction of the ribbon's length, exhibiting magnetic core loss of less than 0.25 W/kg and exciting power of less than 0.35 VA/kg at 60 Hz and 1.3 T induction.

17. The wound magnetic core of claim 16, the ribbon having been annealed in a temperature range between 300° C. and 335° C. in a magnetic field applied along a direction of the ribbon's length.

18. The wound transformer core of claim 13, wherein the core is operating up to an induction level of 1.5 T.

19. The wound transformer core of claim 13, wherein the core has a toroidal shape or semi-toroidal shape.

20. The wound transformer core of claim 13, wherein the core has step-lap joints.

21. The wound transformer core of claim 13, wherein the core has over-lap joints.

22. A method of casting a ferromagnetic amorphous alloy ribbon, the method comprising:

selecting an alloy having a composition represented by $Fe_aSi_bB_cC_d$ where 80.5≤a≤83 at.%, 0.5≤b≤6 at. %, 12≤c≤16.5 at.%, 0.01≤d≤1 at. % with a+b+c+d=100 and incidental impurities;

casting from a molten state of the alloy with a molten alloy surface tension of greater than or equal to 1.1 N/m on a chill body surface; and obtaining the ribbon having a ribbon length, a ribbon thickness, and a ribbon surface facing the chill body surface, the ribbon having ribbon surface protrusions on the ribbon surface facing the chill body surface, the ribbon surface protrusions being measured in terms of a protrusion height and a number of protrusions, a number of points on the ribbon surface with protrusion heights exceeding 3 μm and less than four times the ribbon thickness, and the number of protrusions being greater than zero and less than 10 per area of 1.5 m of the ribbon length and 100 mm of the ribbon width, and the ribbon being capable of being annealed in straight strip form so as to have a saturation magnetic induction exceeding 1.60 T and exhibit a magnetic core loss of less than 0.14 W/kg when measured at 60 Hz and at a 1.3 T induction level.

23. The method of claim 22, wherein the Si content b and the B content c are related to the Fe content a and the C content d according to the relations of b≥166.5×(100−d)/100−2a and c≤a−66.5×(100−d)/100.

24. The method of claim 22, wherein up to 20 at. % of Fe is optionally replaced by Co, and up to 10 at. % Fe is optionally replaced by Ni.

25. The method of claim 22, wherein the alloy further comprises a trace element including both incidental and intentionally added impurities selected from at least a member from the group consisting of Cu, Mn and Cr.

26. The method of claim 25, wherein the Cu content is in a range between 0.005 wt. % and 0.20 wt. %.

27. The method of claim 25, wherein the Mn content is in a range between 0.05 wt. % and 0.30 wt. %.

28. The method of claim 25, wherein the Cr content is in a range between 0.01 wt. % to 0.2 wt. %.

29. The method of claim 22, wherein casting is carried out at temperatures between 1,250° C. and 1,400° C.

30. The method of claim 22, wherein casting is carried out in an environmental atmosphere containing less than 5 vol. % oxygen gas at the molten alloy-ribbon interface.

31. A method of preparing a wound magnetic core, comprising: winding the ribbon of claim 22 into a magnetic core.

32. The method of claim 31, wherein the wound magnetic core is a wound transformer core.

33. The method of claim 31, further comprising: annealing the ribbon in a magnetic core in a magnetic field along a direction of the ribbon's length to form an annealed ribbon, wherein the magnetic core exhibits a magnetic core loss of less than 0.3 W/kg and an exciting power of less than 0.4 VA/kg when measured at 60 Hz and 1.3 T induction.

34. The method of claim 33, wherein annealing is carried out at a temperature in the range between 300° C. and 335° C. in a magnetic field applied along ribbon's length direction.

35. The method of claim 31, wherein the ribbon is cast from the alloy having the chemical composition represented by $Fe_aSi_bB_cC_d$ where 81≤a<82.5 at. %, 2.5<b<4.5 at. %, 12≤c≤16 at. %, 0.01≤d≤1 at. % with a+b+c+d=100 and satisfying the relations of b≥166.5×(100−d)/100−2a and c≤a−66.5×(100−d)/100, and the alloy further comprises a trace element including both incidental and intentionally added impurities at least one member selected from the group consisting Cu, Mn and Cr, wherein the Cu content is at 0.005-0.20 wt. %, the Mn content is at 0.05-0.30 wt. %, and the Cr content is at 0.01-0.2 at. %.

36. The method of claim 33, wherein annealing is carried out in a magnetic field applied along a direction of the ribbon's length to form an annealed ribbon, wherein the magnetic core exhibits a magnetic core loss of less than 0.25 W/kg and an exciting power of less than 0.35 VA/kg when measured at 60 Hz and 1.3 T induction.

37. The method of claim 36, wherein the core is annealed in a temperature range between 300° C. and 355° C. in a magnetic field applied along a direction of the ribbon's length.

38. The method of claim 36, wherein the core operate at an induction level of up to 1.5 T.

39. The method of claim 33, wherein the core has a toroidal shape or semi-toroidal shape.

40. The method of claim 33, wherein the core has step-lap joints.

41. The method of claim 33, wherein the core has over-lap joints.

42. The method of claim 22, wherein in the casting, the molten alloy surface tension of the molten state of the alloy is greater than or equal to 1.25 N/m.

* * * * *